United States Patent [19]

Biggs et al.

[11] Patent Number: 4,969,975

[45] Date of Patent: Nov. 13, 1990

[54] PROCESS FOR FORMING A SHEET OF MATERIAL

[75] Inventors: Ian S. Biggs, High Wycombe; Bronislaw Radvan, Flackwell Heath, both of England

[73] Assignee: The Wiggins Teape Group Limited, Basingstoke, England

[21] Appl. No.: 314,265

[22] Filed: Feb. 24, 1989

Related U.S. Application Data

[63] Continuation of Ser. No. 56,008, May 27, 1987, abandoned.

[30] Foreign Application Priority Data

May 27, 1986 [GB] United Kingdom ..... 8612813

[51] Int. Cl.[5] ..... B28B 1/26; D21D 1/00; D21H 15/00; D21J 1/00

[52] U.S. Cl. ..... 162/101; 162/141; 162/218; 162/231; 264/45.3; 264/50; 264/86

[58] Field of Search ..... 264/45.3, 50, 102, 86, 264/87, 101; 162/101, 141, 218, 231

[56] References Cited

U.S. PATENT DOCUMENTS

| | | | |
|---|---|---|---|
| 2,388,187 | 10/1945 | Salle | 162/164.1 |
| 2,653,870 | 9/1953 | Kast . | |
| 2,795,524 | 6/1957 | Rodman | 154/137 |
| 2,892,107 | 6/1959 | Williams et al. | 264/50 |
| 2,962,414 | 11/1960 | Arledter | 162/145 |
| 3,216,841 | 11/1965 | Thellmann | 264/86 |
| 3,494,824 | 2/1970 | Roberts | 162/152 |
| 3,573,158 | 3/1971 | Pall et al. | 162/131 |
| 3,607,500 | 9/1971 | Field | 264/119 |
| 3,873,336 | 3/1975 | Lambert et al. | 106/306 |
| 4,007,083 | 2/1977 | Ring et al. | 162/101 |
| 4,081,318 | 3/1978 | Wietsma | 162/157 R |
| 4,286,977 | 9/1981 | Klein | 55/524 |
| 4,383,154 | 7/1983 | Tyler et al. | 524/12 |
| 4,451,539 | 5/1984 | Vallee et al. | 428/515 |
| 4,503,116 | 3/1985 | Lapidus | 428/286 |
| 4,643,940 | 2/1987 | Shaw et al. | 428/308.4 |

FOREIGN PATENT DOCUMENTS

| | | | |
|---|---|---|---|
| 230504 | 1/1958 | Australia | 162/181.4 |
| 559853 | 7/1983 | Australia . | |
| 3420195 | 12/1985 | Fed. Rep. of Germany . | |
| 1058932 | 2/1967 | United Kingdom . | |
| 1113792 | of 1968 | United Kingdom . | |
| 1204039 | 9/1970 | United Kingdom . | |
| 1230789 | 5/1971 | United Kingdom . | |
| 1263812 | 2/1972 | United Kingdom . | |
| 2051170 | 1/1981 | United Kingdom . | |
| 2093474 | 9/1982 | United Kingdom . | |

OTHER PUBLICATIONS

1004 Abstracts Bulletin of the Institute of Paper Chemistry, vol. 53 (1982), Aug., No. 2, Appleton, Wisconsin, U.S.A.

"Fibre Foam", Turner & Coswell, 1976, presented at VIIth International Congress on Rheology in Sweden, Aug. 23–Aug. 27, 1976.

*Primary Examiner*—Mary Lynn Fertig

*Attorney, Agent, or Firm*—Burns, Doane, Swecker & Mathis

[57] ABSTRACT

A process for forming a homogeneous sheet from particulate elements, (as herein defined), at least some of which have an inherent vertical mobility (as herein defined) in water at normal temperature and pressure of from about 1 to about 21 cms/sec, which comprises the steps of forming a foamed dispersion of said particulate elements, and depositing and draining said dispersion on a foraminous support.

9 Claims, No Drawings

PROCESS FOR FORMING A SHEET OF MATERIAL

This application is a continuation of application Ser. No. 07/056,008, filed May 27, 1987 now abandoned.

This invention relates to a process for forming particulate, and especially fibrous, material into a layer to form a sheet in which they are well distributed both in the planar direction and the thickness. More particularly, the invention is concerned with the formation of such layers from fluid dispersions, especially aqueous dispersions, of particles or fibres which are vertically mobile in the dispersion medium.

In United Kingdom Patents Nos. 1129757 and 1329409, processes are described for forming a paper web from conventional cellulosic or synthetic papermaking fibres. For complex electro-chemical and mechanical reasons, such fibres tend to flocculate or clump together when in aqueous dispersion, and in consequence tend to give rise to an uneven or "wild" formation in the paper web when formed. The aforementioned UK Patents address this problem and disclose processes which achieve a substantial improvement in formation by the use of a foamed dispersion medium having specified characteristics. The bubble structure of the foam acts to delay and inhibit the flocculation, so that as the foam is broken down by drainage on a Fourdrinier wire of a paper machine, the fibres deposit on the wire before flocculation can occur.

In European Patent Application No. 85.300031, a process is described for forming a precursor for a fibre reinforced plastics material from a foamed dispersion of glass fibres and plastics particles. In this case, the use of a foamed dispersion overcame the disadvantages of using a conventional aqueous unfoamed dispersion. Due to the exceptional tendency of glass fibres to flocculate, a satisfactory web can only be formed using an aqueous dispersion if very low consistencies (of less than 0.1% of fibre) are used. With such dispersions, a web can only be formed very slowly due to the large volumes of water which need to be handled in drainage. The use of a foamed dispersion overcomes this problem.

In the aforementioned disclosures, the fibres or particulate material being dispersed and laid down from the dispersions have only an insignificant tendency to vertical mobility in water in the sense that they will tend to either settle or float. Indeed, they can be dispersed sufficiently in water to be capable of formation into a web even though this leads to the disadvantages discussed above.

It has now been found unexpectedly that a foamed dispersion possesses sufficient integrity and mechanical strength, if correctly formulated, to trap within its structure relatively heavy or light particles or fibres which would tend to settle or float in an aqueous dispersion. Not only does this lead to very even formation of the sheet laid down on the Fourdrinier wire, but, where as is frequently the case, the furnish is comprised of particles and fibres having different inherent vertical mobilities, it leads to the formation of a homogeneous sheet structure. Any attempt to produce a sheet from such a furnish using an unfoamed aqueous dispersion results in relative vertical movement of the particulate and fibrous components in dependence upon their particular settling or floating characteristics, and leads to the formation of layers rather than a homogeneous sheet.

The invention therefore provides a process for forming a homogeneous sheet from particulate elements (as herein defined), at least some of which have an inherent vertical mobility (as herein defined) in water at normal temperature and pressure of from about 1 to about 21 cms/sec, comprising the steps of forming a foamed dispersion of said particulate elements, and depositing and draining said dispersion on a foraminous support. The process of the invention is particularly effective for particles having vertical mobilities of from 5 to 13 cms/sec.

Particulate elements are defined as particles, particulate aggregates, fibres, fibrous flocs or mixtures of these and different kinds thereof.

The term "inherent vertical mobility" is used herein to define the rate at which a particulate element moves in a downward or an upward direction in water and will depend upon the weight and surface area of the particulate elements and the extent to which air is entrapped in the elements or is adherent thereto.

In a preferred process the particulate elements are metallic particles.

If desired a plurality of kinds of particulate elements can be included and which have different inherent vertical mobilities, thus the particulate elements may comprise a mixture of elements which rise and elements which settle in water.

Preferably the foamed dispersion is aqueous and has a viscosity of at least 22 seconds when measured by Ford Cup Type B-4 at 20° C. according to British Standard No. BS1733 or an equivalent viscosity as determined according to British Standard BS3900-A6. Still more preferably, the foamed dispersion has an air content of at least 55% and is comprised of bubbles having an average size of 0.2 mm. Especially preferred are air contents of at least about 65%.

The invention also includes a sheet made by the process set forth.

The invention is illustrated by the following experiments and examples.

Various materials were used in evaluating the inventive concept, including lead shot, chopped metal rod, wire and fibres of various diameters and grit to exemplify materials tending to settle in water. As one example of a light material which floats in water, polystyrene foam was used having a density of 0.023 gram.centimeter$^{-3}$ and was broken down by means of a wire brush into particles in the size range 2 to 5 mm. As another example, expanded heat treated volcanic rock particles sold under the trade name Perlite were used.

The settling rate for each particle was determined by timing the vertical movement of a particle over a distance of 25 cm in a 45 cm high column of water after an initial movement of 18 cm. For filamentary particles the settling rate was noted for those particles (the substantial majority) which assumed a substantially horizontal orientation during settling.

A suitable apparatus for producing foam having the required properties is a modified froth flotation cell of the type made by Denver Equipment Co. of Denver, Colo., U.S.A. Such a cell comprises a casing having means for admission of air thereto and having a bladed impeller mounted for rotation therein, the distance between the impeller and an inner surface of the casing being set such that a liquid containing a surface active agent within the casing, is subjected to a vigorous shearing action between the impeller, when rotating relative to the casing, and the inner surface of the casing, the action being such as to provide bubbles of the required size. In use a vortex is produced in such a cell, bubbles of the required size being present at the base of the vortex and larger bubbles being present at the top of the vortex, which larger bubbles are sucked down to the base of the vortex together with air admitted to the casing, and there formed into bubbles of the required size. During formation of the foam in the cell the fibres or particles to be used can be added to the foam so that they become well dispersed in the foam by the action of the cell. However, the use of such a foam-producing cell is not essential, and any other suitable apparatus can be used.

Foamed dispersions were generated in the Denver cell using 7 liters of water. For metal fibres and particles 20 millimeters of a surfactant Triton X-100 (a water soluble octylphenoxypolyethoxyethanol containing an average of 10 moles of ethylene oxide) made by Rohm and Haas was added, and for grit particles 15 milliliters of the same 5 surfactant. In the case of polystyrene particles, 25 milliliters of a surfactant sold under the trade name Nansa (a 30% solution of sodium dodecylbenzenesulphonate) by Albright and Wilson added.

Various formulations were then made up using as a basis nylon powder and glass fibres to which was added specific metallic particles or fibres, grit expanded polystyrene, or expanded volcanic rock particles. After generation of a foamed dispersion including each formulation in a Denver cell, each dispersion was then, in the cases of Examples 1 to 19, transferred to a laboratory sheet former. After draining, the sheet former and the sheet were examined to determine the proportion of the metallic or grit particles which had been carried by the foam into the sheet. The sheet was also examined to determine the extent to which the three components of the formulation were evenly or homogeneously dispersed both in the planar direction and the thickness.

In the cases of Examples 20 and 21 the sheets were formed on a pilot scale paper machine wet end 0.35 meters wide and running at 5 meters per minute.

In the case of the expanded polystyrene, the material was all carried across because of its proclivity to float and the evenness and degree of integration of the dispersion of particles in the sheet was the characteristic particularly evaluated.

Table 1 sets out the results for metal particles and it will be seen that, although very heavy particles could not satisfactorily be incorporated in the sheet, a surprisingly high level of transference was achieved with particles as large as 550 microns diameter and up to 12 mm long. In Table 2 it will be seen that in excess of 90% transference to the sheet was achieved of grit particles of up to 2.8 mm in diameter. In addition, particles of polystyrene and expanded volcanic rock were successfully trapped in the foam dispersion and transferred so as to produce a sheet in which materials having varying settling rates were evenly distributed.

TABLE 1

DISPERSION OF HEAVY METAL PARTICLES IN FOAM

| | FORMULATION | | | OBSERVATIONS ON TRANSFERENCE OF METAL FIBERS TO SHEET FORMER (THE NON-METALLIC MATERIALS WERE WHOLLY TRANSFERRED | Settling Rate of Metal 'Fibers' in Water |
|---|---|---|---|---|---|
| Example | Nylon 6 Powder | Glass Fibers (12 mm long 11μdia.) | Metal | | |
| 1 | 137 g | 60 g | 30 g No. 9 (1.97 mm dia.) lead shot | Virtually all lead shot remained in the mixer. | Too rapid to measure |
| 2 | 137 g | 60 g | 25 g Chopped Steel Rod (8–10 mm, 1.5 mm dia.) | Virtually all metal remained in the mixer. | Too rapid to measure |
| 3 | 137 g | 60 g | 12 g Stainless Steel Wire (10–12 mm, 910μ dia.) | Metal mostly remained in the mixer. A few 'fibres' unevenly dispersed in sheet. | 30 cm/sec |
| 4 | 137 g | 60 g | 10 g Stainless Steel Wire (10–12 mm, 550μ dia.) | Approx. half the metal 'fibres' remained in bin. Those carried over were quite evenly dispersed. | 20.8 cm/sec |
| 5 | 137 g | 60 g | 3.6 g Stainless Steel Wire (11–12 mm, 375 μ dia.) | 83% of metal 'fibres' were carred over and were evenly dispersed in the sheet. | 16.7 cm/sec |
| 6 | 137 g | 60 g | 2.7 g Stainless Steel Wire (11–12 mm, 270μ dia.) | 90% of metal 'fibres' were carried over and evenly dispersed in the sheet. | 12.5 cm/sec |
| 7 | 137 g | 60 g | 5 g Brasswashed Steel fibers (12½ mm, 180μ dia.) | 98% of metal fibres were carried over and evenly dispersed in the sheet. | 8.3 cm/sec |
| 8 | 82% vol. | 16.75% vol. | 1.25% vol iron reinforcing fibres (25 mm × 170μ dia. with flats ~ 225μ wide) | In Excess of 70% of the metal fibres were carried over and evenly dispersed in the sheet. | 7.1 cm/sec |
| 9 | 82% vol. | 15.5% vol. | 2.5% vol iron reinforcing fibres (25 mm × 170μ wide with flats ~ 225μ dia.) | In excess of 70% of the metal fibres were carried over and evenly dispersed on the sheet. | 7.1 cm/sec |
| 10 | 82% vol. | 15.5% vol. | 2.5% vol Brasswashed Steel fibres (12.5 mm × 180μ wide) | 98% of the metal fibres were carried over evenly dispersed on the sheet. | 8.3 cm/sec |
| 11 | 82% vol. | 15.5% vol. | 2.5% vol Copper wire (~25 mm × 190μ dia.) | In excess of 50% of the metal fibres were carried over and evenly dispersed in the sheet. | 10.0 cm/sec |
| 12 | 82% vol. | 12.0% vol. | 6.0% vol Aluminium alloy (Durol) swarf (~5 mm × 1.5 mm × 200μthick) | In excess of 50% of the swarf was carried and evenly dispersed in the sheet. | 5.1 cm/sec |
| 13 | 137 grams | 60 grams | Grade No. 2 Steel Wool cut into filaments approximately 10 mm long | In excess of 95% of the filaments were carried over and evenly dispersed in the sheet | 3.5 cm/sec |
| 14 | 132 grams polypropylene powder ICI grade | 45 grams | 13 grams Stainless steel fibres 12μ diameter, 10 millimetres long. | In excess of 95% of the fibres were carried over and evenly dispersed in the sheet. | 1.2 cm/sec |

TABLE 1-continued

| DISPERSION OF HEAVY METAL PARTICLES IN FOAM | | | | | |
|---|---|---|---|---|---|
| | FORMULATION | | | OBSERVATIONS ON TRANSFERENCE OF METAL FIBERS TO SHEET FORMER (THE NON-METALLIC MATERIALS WERE WHOLLY TRANSFERRED | Settling Rate of Metal 'Fibers' in Water |
| Example | Nylon 6 Powder | Glass Fibers (12 mm long 11μdia.) | Metal | | |
| | PRC 81604 | | | | |

TABLE 2

| DISPERSION OF HEAVY GRIT PARTICLES IN FOAM | | | | | |
|---|---|---|---|---|---|
| Example | Nylon 6 Powder | Formulation Glass Fibers (12 mm long 11μ dia.) | Potting Grit | Observation of Transference of Grit to Sheet Former (the other materials were wholly transferred) | Settling Rate of Grit Particles in Water |
| 15 | 135 g | 45 g | 45 g (sieved to 1.7–2.8 mm) | 91% of grit was carried over and evenly dispersed in the sheet. | 13.0 cm/sec |
| 16 | 135 g | 45 g | 60 g (sieved to 1.0–1.7 mm) | 96% of grit was carried over and evenly dispersed in the sheet. | 8.1 cm/sec |

TABLE 3

| DISPERSION OF EXPANDED POLYSTYRENE PARTICLES IN FOAM | | | |
|---|---|---|---|
| Examples | Formulation | Observations on transference to sheet former | Settling Rate of Expanded particles in Water. |
| 17 | 60 g beaten woodpulp<br>35 g Expanded polystyrene particles (2–5 mm)<br>30 g Glass Fibre (12 mm long, 11μ dia.) | No tendency of formulation to separate. Even dispersion of particles in the sheet. | 4.5 mm–13.3 cm/sec |
| 18 | 67% Expanded polystyrene particles (2–5 mm)<br>33% Glass fibre (12 mm long, 11μ dia.) | | 2 mm–5.0 cm/sec |
| 19 | 12 g Perlite*<br>54 g Glass Fibre (12 mm long, 11μ dia.) | | Between - 6 cm/sec and - 12 cm/sec |

*An expanded heat treated volcanic rock sold by Silver Perl Products Harrogate, England.

EXAMPLE 20

The following formulation was loaded into a Denver froth flotation cell of the kind herein described 3.0 Kilograms of brass fibres 90μ diameter 12.5 millimeters long and having a settling rate of 5 centimeters per second.

4.2 Kilograms of Glass Fibres 11μ diameter, 13 millimeters long 11.3 Kilograms of polypropylene powder sold by ICI as grade PXC81604

450 liters of water 450 millimeters of s surfactant sold under the trade name Triton X-100 by Rohm and Haas.

After formation of a foamed suspension in the manner herein described, the suspension was pumped to the headbox of the pilot plant paper machine wet end on which web was then formed. After drying the web weighed 1040 grams per square meter and exhibited a uniform distribution of fibres.

The web was then consolidated under heat and pressure to produce, after cooling, a rigid reinforced sheet in which the brass fibres were clearly seen to be evenly and uniformly distributed.

EXAMPLE 21

A consolidated sheet was formed in the same manner as that described in Example 20 but using the following formulation 4.2 Kilograms of crescent section Bronze fibres having an effective diameter of 40μ, 3 millimeters long and having a settling rate of 1.5 centimeters/second 5.3 Kilograms of Glass Fibres 11μ diameter, 13 millimeters long 11.9 Kilograms of polypropylene powder sold by ICI as grade PXC81604

450 liters of water 1.3 liters of a surfactant sold under the trade name Nansa by Albright and Wilson Ltd.

The web formed on the pilot plant wet end weighed, after drying, 830 grams per square meter. When the web was consolidated under heat and pressure it produced, on cooling, a rigid reinforced sheet in which the bronze fibres could be seen to be evenly and uniformly distributed.

What is claimed is:

1. A process for forming a homogeneous sheet from particulate elements at least some of which have an inherent vertical mobility in water at normal temperature and pressure of from about 5 to about 21 cms/sec, which comprises the steps of forming an aqueous foamed dispersion of said particulate elements, and depositing and draining said dispersion on a foraminous support.

2. A process as claimed in claim 1 in which said particles have vertical mobilities of not more than about 13 cms/sec.

3. A process as claimed in claim 1 in which said particulate elements comprise metallic particles.

4. A process as claimed in claim 1 in which a plurality of kinds of particulate elements are included and which have different inherent vertical mobilities.

5. A process as claimed in claim 4 in which the particulate elements comprise a mixture of elements which rise and elements which settle in water.

6. A process as claimed in any one of the preceding claims 1 to 5 in which the foamed dispersion is aqueous and has a viscosity of at least 22 second when measured by Form Cup Type B-4 at 20° C. according to British Standard No. BS1733 or an equivalent viscosity as determined according to British Standard BS3900-A6.

7. A process as claimed in any one of claims 1 to 5 in which the foamed dispersion has an air content of at least 55% and is comprised of bubbles having an average size of 0.2 mm.

8. A process as claimed in claim 7 in which the foamed dispersion has an air content of at least about 65%.

9. A sheet formed by the process set forth in any one of the claims 1 to 5.

* * * * *